US007073734B2

(12) United States Patent
Dorendorf et al.

(10) Patent No.: US 7,073,734 B2
(45) Date of Patent: Jul. 11, 2006

(54) SPRAYING DEVICE SYSTEM AND METHOD OF DISPERSING AND DISSEMINATING MATERIALS

(75) Inventors: Bruce Dorendorf, Winnebago, MN (US); Veryln Ripley, Elmore, MN (US)

(73) Assignee: Advanced Specialized Technologies, Inc., Winnebago, MN (US)

( * ) Notice: Subject to any disclaimer, the term of this patent is extended or adjusted under 35 U.S.C. 154(b) by 0 days.

(21) Appl. No.: 10/867,135

(22) Filed: Jun. 14, 2004

(65) Prior Publication Data

US 2004/0222318 A1 Nov. 11, 2004

Related U.S. Application Data

(62) Division of application No. 10/318,927, filed on Dec. 13, 2002, now Pat. No. 6,805,307.

(60) Provisional application No. 60/341,326, filed on Dec. 13, 2001.

(51) Int. Cl.

| | |
|---|---|
| ***A62C 31/00*** | (2006.01) |
| ***A62C 5/00*** | (2006.01) |
| ***B05B 7/04*** | (2006.01) |
| ***F23D 11/36*** | (2006.01) |
| ***F23D 11/40*** | (2006.01) |

(52) U.S. Cl. ..... 239/398; 239/318; 239/77; 239/411; 239/418

(58) Field of Classification Search ..... 239/398, 239/318, 77, 411, 418, 407–409, 412–414, 239/104, 114–118, 302, 310, 340, 341, 344
See application file for complete search history.

(56) References Cited

U.S. PATENT DOCUMENTS 2,201,995 A 5/1940 Erickson (Continued)

FOREIGN PATENT DOCUMENTS

EP 0131120 A1 5/1984

(Continued)

OTHER PUBLICATIONS

Manual for "BOA Flow Control Belt Operated ASP Pump: Instruction Manual with Parts List", Lowndes Engineering Co., Inc., Valdosta, Georgia.

(Continued)

*Primary Examiner*—David A. Scherbel
*Assistant Examiner*—Darren Gorman
(74) *Attorney, Agent, or Firm*—Dobrusin & Thennisch, PC

(57) ABSTRACT

The invention includes a spraying device (10) for producing a precise degree of liquid droplet generation on a repeatable basis by combining a specified rate of regulated flow of liquid material with a regulated flow of high-pressure air. The spraying device (10) includes an electric or engine driven direct drive compressor (12). Coupled to the compressor (12) is an air storage tank (14) providing air pulsation reduction to the regulated air and serves as a reservoir for excess airflow generation. A Venturi nozzle (18) is connected to the compressor (12). A liquid supply tube (24) uses a fixed or variable restriction to regulate the liquid flow to the nozzle (18). The vacuum in the liquid supply line (24) draws this liquid flow and mixes the liquid externally with the regulated air in exacting proportions forming specified liquid droplet sizes. The device (10) uses air and liquid regulation combined with a Venturi nozzle (18) and is able to generate extremely consistent liquid droplet sizes.

20 Claims, 9 Drawing Sheets

U.S. PATENT DOCUMENTS

| | | | | |
|---|---|---|---|---|
| 3,239,960 | A | 3/1966 | Stevens | |
| 3,304,011 | A | 2/1967 | Paasche | |
| 3,735,929 | A | 5/1973 | Pleines | |
| 3,776,459 | A | 12/1973 | Bonvicini | |
| 3,900,165 | A | 8/1975 | Parke et al. | |
| 3,917,168 | A | 11/1975 | Tenney | |
| 4,116,385 | A | 9/1978 | Waldron | |
| 4,182,491 | A * | 1/1980 | Parke et al. | 239/11 |
| 4,474,327 | A | 10/1984 | Mattson et al. | |
| 4,781,329 | A | 11/1988 | Tenney et al. | |
| 5,299,737 | A | 4/1994 | McGinnis et al. | |
| 5,340,026 | A | 8/1994 | Woodruff | |
| 5,341,644 | A * | 8/1994 | Nelson | 60/627 |
| 5,392,996 | A | 2/1995 | Ussery | |
| 5,441,297 | A | 8/1995 | Krohn et al. | |
| 5,873,530 | A | 2/1999 | Chizinsky | |
| 6,003,787 | A | 12/1999 | Fisher | |
| 6,012,647 | A | 1/2000 | Ruta et al. | |
| 6,206,300 | B1 * | 3/2001 | Roudebush et al. | 239/77 |
| 6,272,790 | B1 | 8/2001 | Paganessi et al. | |
| 6,409,097 | B1 | 6/2002 | McCauley | |
| 6,446,881 | B1 * | 9/2002 | You | 239/146 |
| 2002/0030117 | A1 | 3/2002 | Bryan et al. | |
| 2002/0030119 | A1 | 3/2002 | Proharam | |

FOREIGN PATENT DOCUMENTS

| | | |
|---|---|---|
| WO | WO98/07525 | 2/1998 |
| WO | WO98/57753 | 12/1998 |
| WO | WO99/09291 | 2/1999 |
| WO | WO99/15279 | 4/1999 |
| WO | WO99/39834 | 8/1999 |
| WO | WO99/43441 | 9/1999 |
| WO | WO01/64352 | 9/2001 |
| WO | WO01/72432 | 10/2001 |

OTHER PUBLICATIONS

Manual for "LECO CV Flow Control with Digital Meter: Manual Supplement for Digital Meter Effective Serial No. 6700756 - - - up", Lowndes Engineering Co., Inc., Valdosta, Georgia.

Manual for "LECO CV-E Flow Control with Digital Meter: Manual Supplement for Digital Meter Effective Serial No. 6900192 - - - up", Lowndes Engineering Co., Inc., Valdosta, Georgia.

Manual for "LECO CV Flow Control: Instruction Manual and Parts List", Lowndes Engineering Co., Inc., Valdosta, Georgia.

Manual for "LECO ULV FOG Generator Model HD", Lowndes Engineering Co., Inc., Valdosta, Georgia.

Manual for "LECO MODEL P-1 ULV Fog Generator: Instruction Manual and Parts List", 1989, 1991 Lowndes Engineering Co., Inc., Valdosta, Georgia.

Manual for "Model Mini II ULV Fog Generator: Instruction Manual and Parts List", 1990 Lowndes Engineering Co., Inc., Valdosta, Georgia.

Manual for "Model 500 ULV Fog Generator: Instruction Manual and Pats List", Lowndes Engineering Co., Inc. Valdosta, Georgia.

Textbook titled "Lowndes Engineering Co., Inc. Equipment School: Quality is Economy", Lowndes Engineering Co., Inc., Valdosta, Georgia.

* cited by examiner

SPRAYING DEVICE SYSTEM AND METHOD OF DISPERSING AND DISSEMINATING MATERIALS

RELATED CASES

The present application is a divisional of U.S. patent application Ser. No. 10/318,927, filed on Dec. 13, 2002 now U.S. Pat. No. 6,805,307, which is also claims the benefit of Provisional Application No. 60/341,326, filed Dec. 13, 2001 and is incorporated herein by reference.

TECHNICAL FIELD

The present invention relates generally to an improved device, system, and method for the spraying and application of liquids and/or liquid-gas mixtures for a number of purposes such as: insect control/eradication, pesticide applications, medicinal or medical product spraying applications, including spraying antibiotics among livestock, chickens, pigs, etc. and antidotes for potential terrorist activities, herbicide applications, insecticide applications, paint applications, misting applications, cooling applications, water applications, fertilizer applications, horticultural applications, solid-stream applications, and application of cleaning/stripping/degreasing solutions for household and industrial uses. More particularly, the present invention relates to a cost effective, low-maintenance, and transportable liquid spraying system for the efficient application of liquid materials used to control insect populations, such as mosquito control products.

BACKGROUND OF THE INVENTION

Traditional mosquito control methods and spraying systems utilized and found in the prior art generally consisted of thermal smoke generators. Typically, this device or process involves the creation of a gaseous smoke that serves as a carrier for the selected insecticide, pesticide, water, petroleum or synthetically formulated liquids. The use of thermal smoke generators, particularly when mounted on motorized vehicles, can often create visual obstructions and lead to dangerous spraying conditions, especially in residential areas. In addition, the application of the gaseous smoke can be inefficient, uneven, require a large amount of pesticide to be integrated with the gaseous smoke, and can be poorly targeted due to the influence of ambient environmental and weather conditions, such as wind, topography, etc.

More recently, spraying techniques have begun to utilize Cold Aerosol Ultra Low Volume (ULV) generators to disperse insect and mosquito control products. Ultra Low Volume technology provides a light cloud of spray comprising a very specific size of droplet. The use of Ultra Low Volume generators typically allow an efficient delivery of a very specific amount of liquid or chemical to the targeted areas inhabited by insects, such as the mosquito, thereby reducing the amount of liquid chemical required for spraying. Typically, the Ultra Low Volume spray clouds are generated through the use of either gas driven blowers or electrically driven rotary sleeves. The Ultra Low Volume blowing equipment can produce a significant amount of undesirable emissions and comprise a number of components which need to be maintained and/or calibrated, such as pumps, meters, flow controls, and filtering devices. In this regard, the expense of such equipment is often cost prohibitive to many smaller municipalities, commercial applicators, or homeowner/development groups that seek to provide mosquito control and insect spraying services to its citizens and residents.

While these prior art devices can perform well and do effectuate mosquito control in many circumstances, they often require a large capital investment to place the equipment into service, utilize a large amount of maintenance resources during operation as well as storage space during periods of non-use, and require additional labor demand to monitor and maintain the systems to ensure that they are in working order when needed. For instance, multi-component Ultra Low Volume spraying packages often require placement and mounting upon dedicated spraying vehicles. In turn, the entity or organization charged with responsibility for the spraying application process is required to devote both financial and technical resources to transportation the multi-component equipment during operation and justify the expenses to its respective constituency, residents, or other recipients of the spraying services.

Moreover, in recent years, state and federal health agencies and organizations in the United States have documented the introduction and spread of a number of viruses and diseases that have been traced to airborne-carrying insects, such as the mosquito. For example, the West Nile Virus and forms of malaria and encephalitis have been identified in both human and animal subjects. In some cases, these viruses have been fatal to humans with children and the elderly being particularly susceptible. At the same time, state and federal environmental legislation and environmental preservation causes have sought protection for "wetlands" areas to preserve the natural environment in designated areas which may be directly adjacent to areas inhabited by human residents. Although preservation of natural resources and the ecosystem are important objectives, a traditional "wetlands" area is generally conducive to the habitation and breeding of large numbers of mosquito populations. Given the airborne and mobile nature of a flying insect, such as the mosquito, the mosquito population often comes into contact with human inhabitants living nearby.

In response to these newly documented health dangers being carried by the mosquito and potential human transmission of life-threatening diseases through contact with the mosquito, both the public and governmental authorities have focused on the need to protect residential populations through cost-effective mosquito control management programs. In so doing, one of the clearest and basic needs is to provide physical equipment and infrastructure to facilitate the application of spraying techniques to control the mosquito population in residential areas.

Accordingly, there is need for a simple low cost system and spraying technique that provides an integrated and dependable application of selected liquid materials to designated geographic areas.

SUMMARY OF THE INVENTION

The present invention is directed to a spraying system and techniques/methods for the application of liquid materials to targeted portions of the ambient environment, and particularly one for the efficient spraying of selected liquid droplets, such as (without limitation) liquids employing chemical formulations for insect control/eradication, herbicide application, insecticide application, paint application, water application, fertilizer application, antibiotic application and application of cleaning, stripping, and degreasing solutions for household and industrial uses. Although it is contemplated that the present invention has particular application and utility in the field of spraying and disseminating formulations and agents to facilitate mosquito and insect control thereby protecting human populations from diseases and pathogens, such as the West Nile Virus, malaria, and various forms of encephalitis, it should be seen that the present invention may also be utilized to deliver formulations and agents to control mosquitos and various insects among animal and livestock populations, zoos, food production facilities that utilize live animals, and game preserves. Further, the present invention could be utilized to deliver airborne medical products, vaccines, and antidotes to both human and animal populations in response to a specific medical or epidemiological event. The system generally employs a kit or combination of spraying equipment which is lightweight, compact, and requires a relatively low level of maintenance on the part of the entity applying the materials. The system functions through the spraying of accurate and efficient droplets through the combination of fluid and air by means of a low emission engine or other power source and a compressor. It is contemplated that the present invention may further comprise a dual-use feature having functionality as an air compressor with regulated air take-off whereby a plurality of tools or devices could also be powered through the air compressor utilizing various forms of fittings, such as quick disconnect fittings known in the art.

In a particular preferred embodiment, the efficient liquid droplet size may have fixed or variable flow capabilities, which can be gravity or siphoned fed, and facilitated through the use of at least one nozzle (single or multiple). The nozzle utilized in the present invention may be fed by gravity, siphon, pressure feed, or other pressure fed internal or external mix design. For instance, the present invention may utilize a Venturi-type nozzle, a high-pressure nozzle, hydraulic nozzle, siphon or gravity fed air assisted nozzle, air atomizing nozzle, blow-off nozzle, ultrasonic nozzle, thermal nozzle applications and technology, and all other forms of atomizing or spray nozzles. Although it is contemplated that a preferred nozzle is a Venturi-type nozzle configuration, it should be seen that the present invention may also comprise any number of liquid pressure fed nozzles, having either an internal or external mix, as well as the use of a pressure fed pump configuration. Generally speaking, air assisted nozzles provide very fine droplets that are smaller in size than traditional nozzles. The nozzle of the present invention may or may not have drip characteristics and/or automatic self-cleaning features to reduce the maintenance and clean-up demand depending upon the selected application or spraying environment. Further, the nozzle design of the present invention may incorporate and utilize a variety of patterns such as flat, full cone, hollow cone, fan, etc.

The present invention further serves to provide a method or technique for the application of liquid materials, such as insecticides, pesticides, and herbicides, natural or synthetic, for the reduction and control of mosquito populations, through the use of spraying kit or set of components which can be mounted and/or transported in the bed of a vehicle or other transportation device. For example, such components could be mounted within a land transportation vehicle, attached to a backpack type configuration for mobile use, or be used as an attachment to conventional lawn and garden equipment, such as a leaf blower, tractor, lawnmower, or the like. The spraying of the droplet particles can be effectuated in accordance with the teachings of U.S. Pat. No. 5,873,530 ("Liquid Atomizing Spray Gun"), WO 99/43441 ("Sprayer For Liquids And Nozzle Insert"), and WO 99/39834 ("Spray Apparatus"), all of which are hereby expressly incorporated by reference. More particularly, the present invention and system may achieve atomization of a material selected for application in a wide variety of ways. For example, the liquid may be atomized through mechanical shearing, high-pressure air atomization, high-liquid pressure, or vibration. Further, the specific objects, specifications, features and improvements of the present invention can be briefly summarized as follows:

In a first preferred embodiment, the present invention is a regulated flow of a liquid material spraying machine that is composed of at least four major components: a direct drive engine and compressor assembly, a fluid formulation tank and attachments, an air tank frame assembly, and a nozzle assembly. The nozzle assembly is preferably a specialized nozzle that creates uniform droplet output and provides for an air-activated nozzle clean-out feature.

Other preferred embodiments of the invention include additional features such as a spraying device that includes two separate units formed of the above components that are easily combined or broken down for shipping, a spraying device that may be attached to a pre-existing portable air compressor and a spraying device providing a variable flow Ultra Low Volume liquid formulation spraying.

These and other objects of the present invention will become apparent upon reading the following detailed description in combination with the accompanying drawings, which depict systems and components that can be used alone or in combination with each other in accordance with the present invention.

DESCRIPTION OF THE PREFERRED EMBODIMENT

A number of advantages are realized in accordance with the present invention, including, but not limited to, the ability to deliver and apply a liquid atomized spray to targeted portions of the ambient environment.

Figure 1:
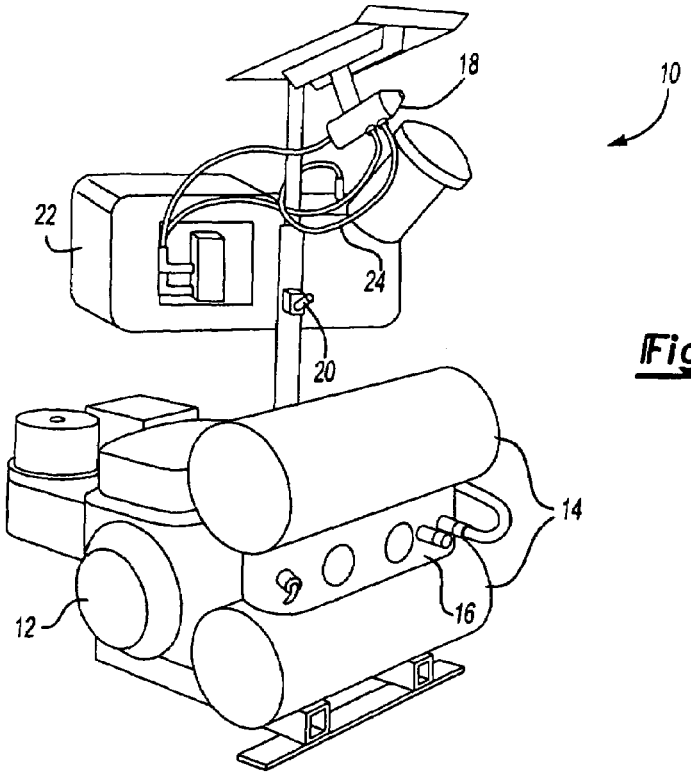
FIG. 1 illustrates a perspective view of a first preferred embodiment of the present invention.

With reference to FIG. 1, a first preferred embodiment of the present invention is there shown and includes a spraying device 10 able to produce a precise degree of liquid droplet generation on a repeatable basis by combining a specified rate of regulated flow of a liquid material with a targeted and regulated flow of high-pressure air.

Specifically, the spraying device 10 includes an engine driven direct drive compressor 12 that can be powered by electricity, gasoline, diesel fuel, ethanol, kerosene, hydraulic, air motor, electrical motor, fuel cell technology, or the like. In addition, the engine driven compressor 12 can utilize direct drive, belt drive, chain drive, or gear driven technology known in the art. Coupled to the compressor 12 is at least one, and more preferably two, air storage tank 14. These tanks 14 provide air pulsation reduction to the regulated air stream and also serve as a reservoir for excess airflow generation. Intermediate the compressor 12 and storage tanks 14 is an automatic engagement switch 16. The compressor 12 is engaged and disengaged from generating high-pressure air to the reservoir storage tanks 14 by means of the automatic engagement switch 16. A specialized Venturi nozzle 18 is connected to the compressor 12 via a manual switch 20. During operation, the regulated airflow is applied from the compressor 12 to the nozzle 18 via the manual switch 20. The nozzle 18 is also connected to a reservoir tank 22 by a liquid supply tube 24.

Figure 2:
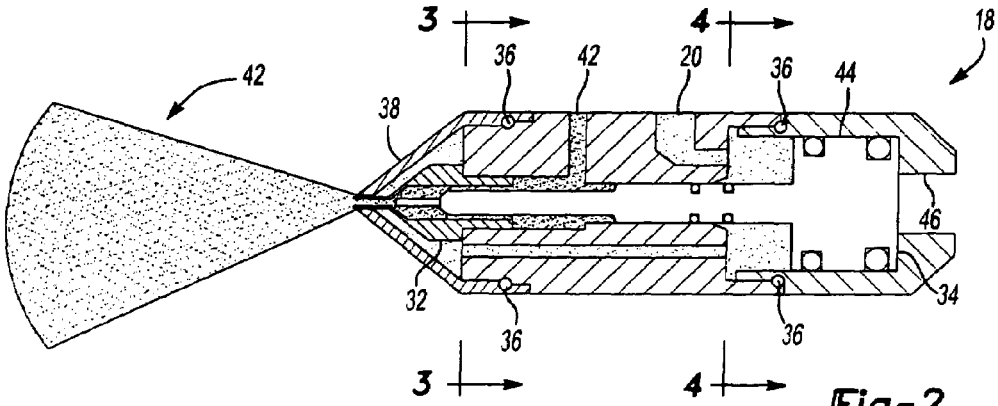
FIG. 2 illustrates a cross-sectional view of a Venturi nozzle of the present invention in a spray ON position.
Figure 3:
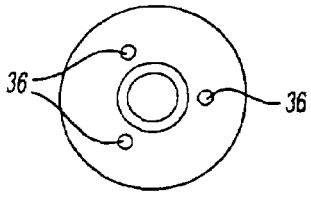
FIG. 3 illustrates cross-section A—A of FIG. 2.
Figure 4:
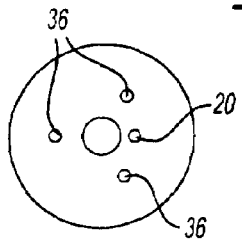
FIG. 4 illustrates cross-section B—B of FIG. 2.
Figure 5:
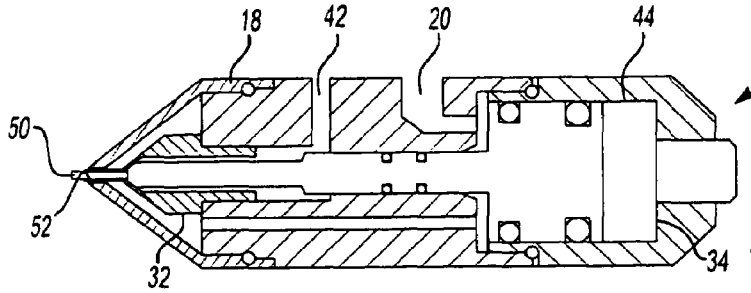
FIG. 5 illustrates a cross-sectional view of a Venturi nozzle of the present invention in a spray CLEAN position.
Figure 6:
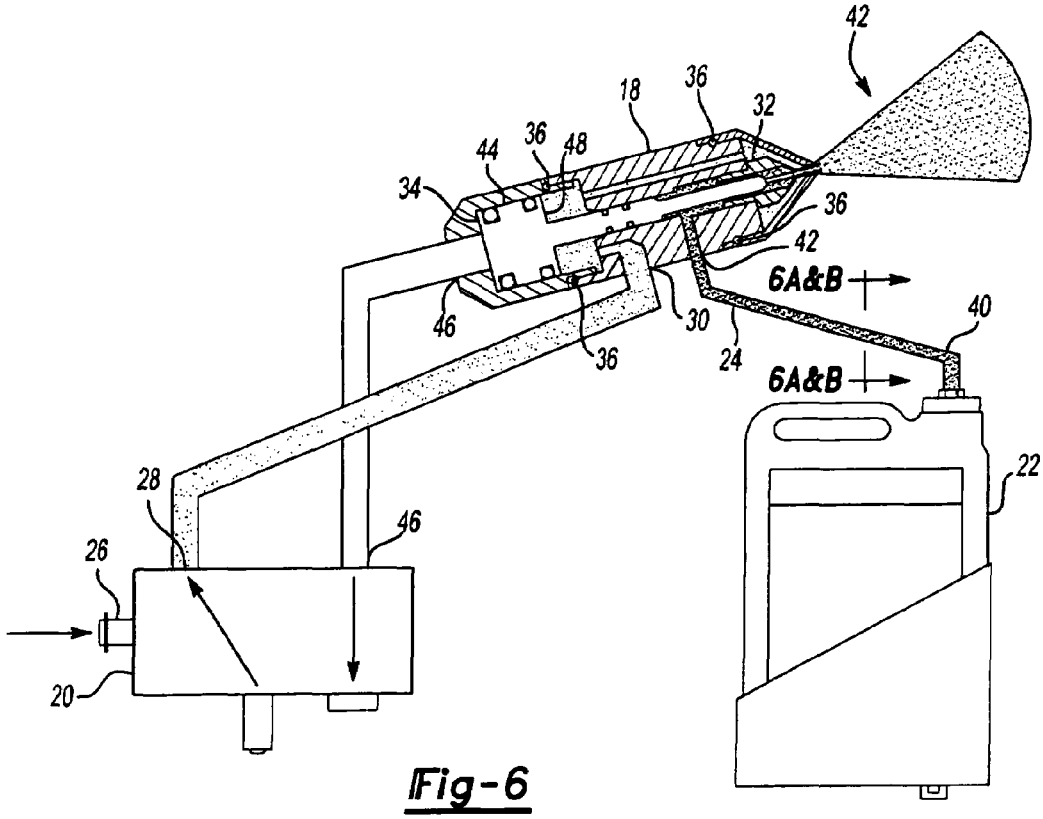
FIG. 6 illustrates a cross-sectional view of the spray circuit of the present in a spray ON position.

FIGS. 2–8 illustrate the preferred method for operating the spraying device 10 and the interior workings of the Venturi nozzle 18. In this embodiment, the manual switch 20 is preferably a 4 way, 3-position manual control pneumatic valve with an operating pressure of 200 p.s.i. (13.8 bar.) The switch 20 is preferably a closed center valve. When the switch 20 is in the ON position (FIG. 6), the spool 26 is pushed in placing the spraying device 10 in "spray" position. The air pressure in the switch 20 is routed through an outlet 28 leading to a nozzle air inlet 30 (FIGS. 2, 5 and 6). Once inside the nozzle 18, the air forces the piston/needle assembly 32 backward toward the interior rear end 34 of the nozzle 18. The compressed air is then ejected through Venturi injectors 36 (FIGS. 2 and 4) into the nozzle cone 38. As the compressed air is ejected through the Venturi injectors 36, a vacuum is created that constantly draws fluid 40 up from the reservoir tank 22 located below the nozzle 18. The fluid 40 enters the nozzle cone 38 at the fluid inlet 42 forward of the air inlet 20. The compressed air passes through the fluid 40 pulverizing the liquid into a fog 42 that is propelled into the ambient air. If the compressed air fails, no vacuum is formed and fluid 40 will not draw from the reservoir tank 22, making the nozzle 18 dripless. Additionally, if any air remains trapped behind the piston/needle 32 within the piston/needle chamber 44 when the piston/needle 32 is forced rearward, the air escapes through the control valve's 20 exhaust port 46.

Figure 6A:
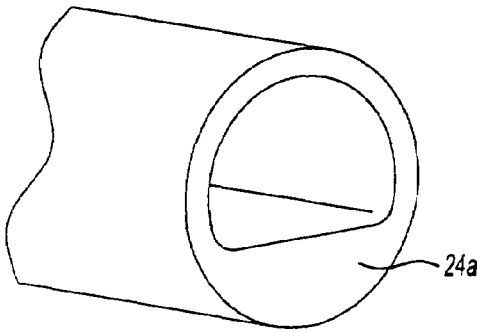
FIGS. 6A and 6B illustrate cross-section A—A of FIG. 6 showing a fixed and variable restriction, respectively, for the liguid supply line.
Figure 6B:
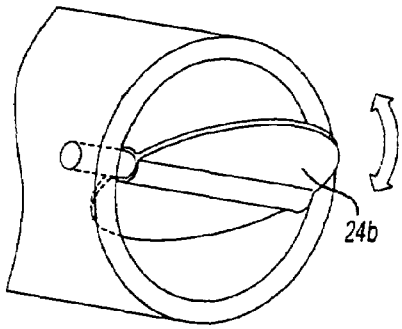
Figure 7:
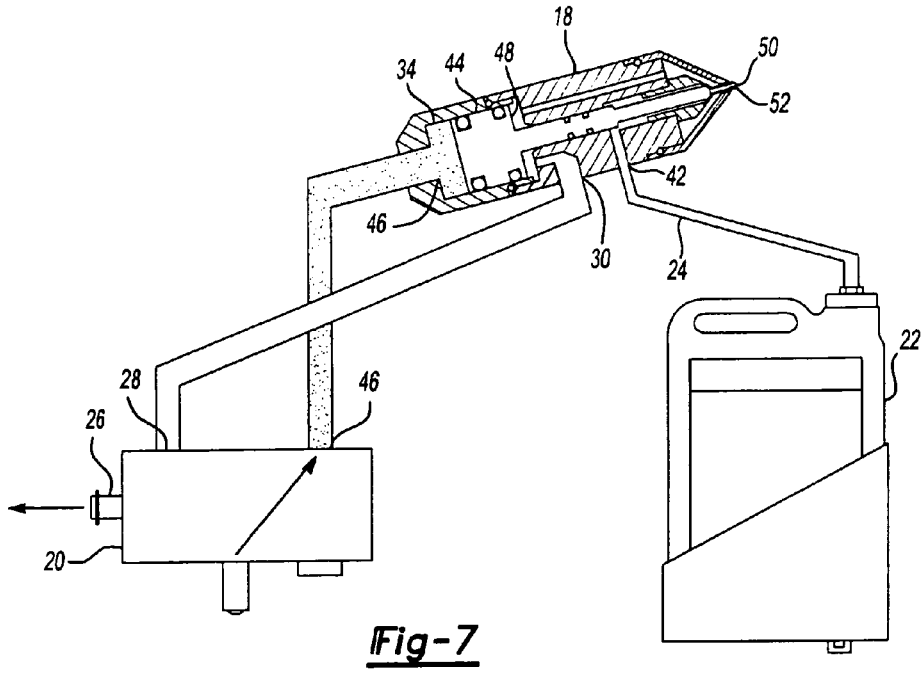
FIG. 7 illustrates a cross-sectional view of the spray circuit of the present in a spray CLEAN position.
Figure 8:
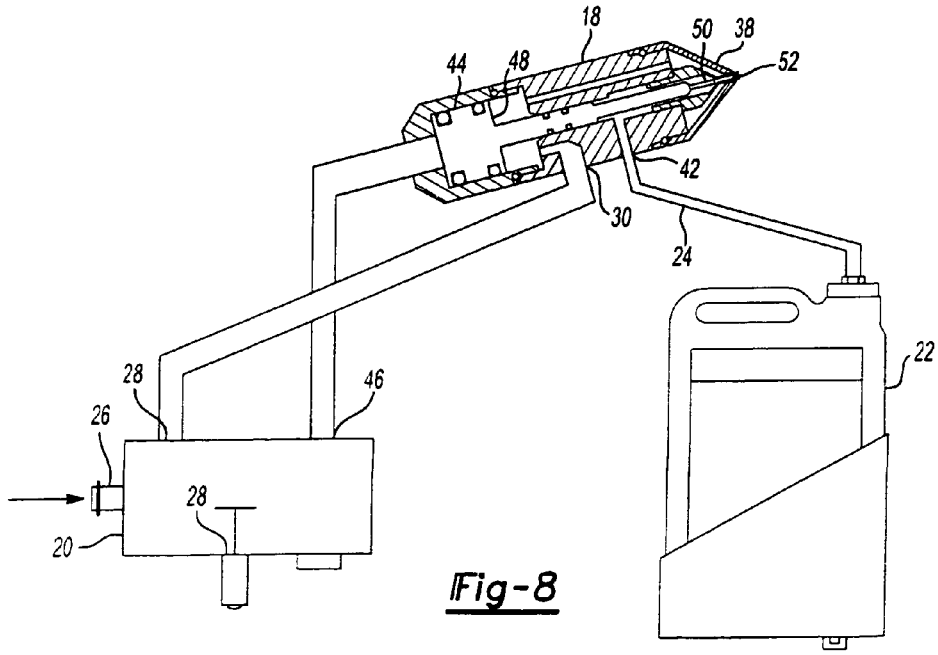
FIG. 8 illustrates a cross-sectional view of the spray circuit of the present invention in a spray OFF position.

The Venturi design of the nozzle 18 causes a vacuum or low-pressure area to be generated in the liquid supply tube 24 extending from the nozzle 18 toward the reservoir tank 22 when the high-pressure air is exiting the nozzle 18. The liquid supply tube 24 may use a fixed 24A or variable restriction 24B (FIGS. 6A and 6B, respectively) to regulate the liquid flow to the nozzle 18. The low-pressure vacuum in the liquid supply line then draws this regulated liquid flow or alternatively, the liquid 40 is pushed up the tube 24 by the higher pressure atmospheric pressure being applied to the liquid 40 in the reservoir tank 22, and mixes the liquid externally with the regulated high-pressure air in exacting proportions forming specified liquid droplet sizes. This air/liquid ratio at regulated pressures is critical to repeatable and predictable liquid droplet size generation. Because the spraying device 10 uses both air and liquid regulation combined with a Venturi nozzle, the device 10 is able to generate extremely consistent liquid droplet sizes.

When the switch 20 is in the off position (FIG. 8), spool 26 is centered. Both air outlets 28, and air exhaust port 46 are blocked and as a result, no air is allowed to pass through the valve switch 20 to either inlet 30,42 of the nozzle 18. Since the Venturi nozzle requires compressed air flowing through the nozzle to siphon fluid from the lower reservoir tank 22, no fluid flows through the system in this position, making the nozzle 18 dripless.

To clean out the nozzle 18 (FIGS. 5 and 7), the spool 26 on control valve 20 is pulled out, thereby routing the compressed air through the control valve 20 into the exhaust port 46 leading to the rear end of the nozzle 34. Once inside the piston/needle chamber 44 of the nozzle 18, the compressed air forces the piston/needle assembly 32 forward allowing the air on the front side 48 of the piston/needle assembly 32 to exit the nozzle 18. The cleaning needle 50 is located opposite the piston of the assembly 32 and is forced out of the nozzle 18 into the ambient air clearing away any debris in the nozzle tip 52. This clean out feature allows the operator of the device 10 to clean any obstructions from the nozzle 18 without any nozzle disassembly or machine shut down.

Figure 9A:
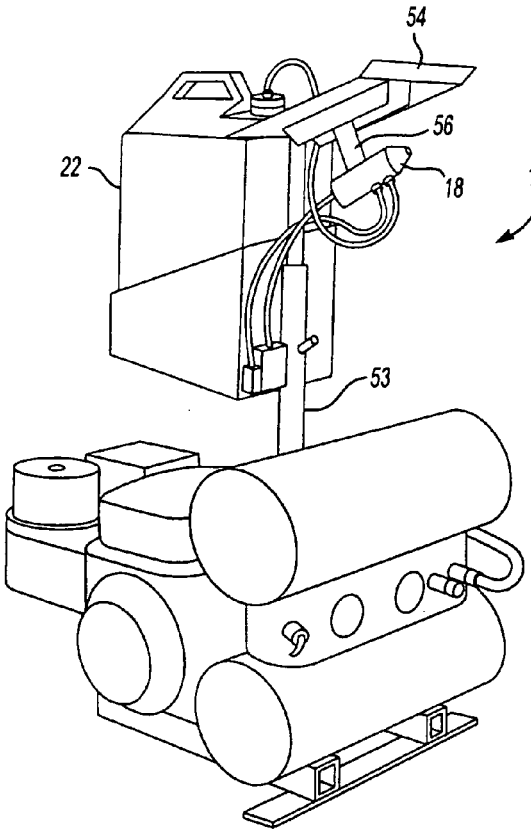
FIGS. 9A and 9B illustrate additional structures for use with the present invention.
Figure 9B:
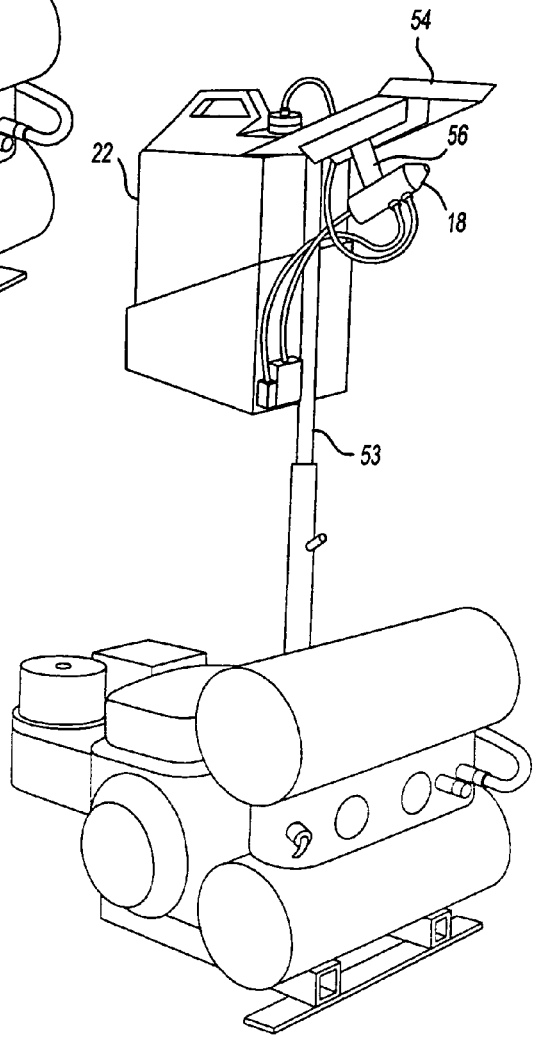

An advantage of the device 10 is that the reservoir tank 22 with nozzle 18 may be located on an adjustable arm 53 as shown in FIGS. 9A and 9B, allowing the spraying component of the device to be vertically adjusted between a lower position (FIG. 9A) and a higher extended position (FIG. 9B.) This allows an operator to reach ceilings or other high areas, such as trees, while spraying without having to elevate the entire device. A still other advantage is that the device 10 may be equipped with a shield 54 having a support arm 56 for holding the nozzle 18 in position. The nozzle 18 with reservoir tank 22 may be adjusted vertically and the nozzle 18 aimed in a desired position. The operator may be in a distant location and able to operate the device either manually or remotely to protect themselves from the dispersed fluid. The shield 54 may direct and guide the dispersed fluid to a discreet area.

Figure 10:
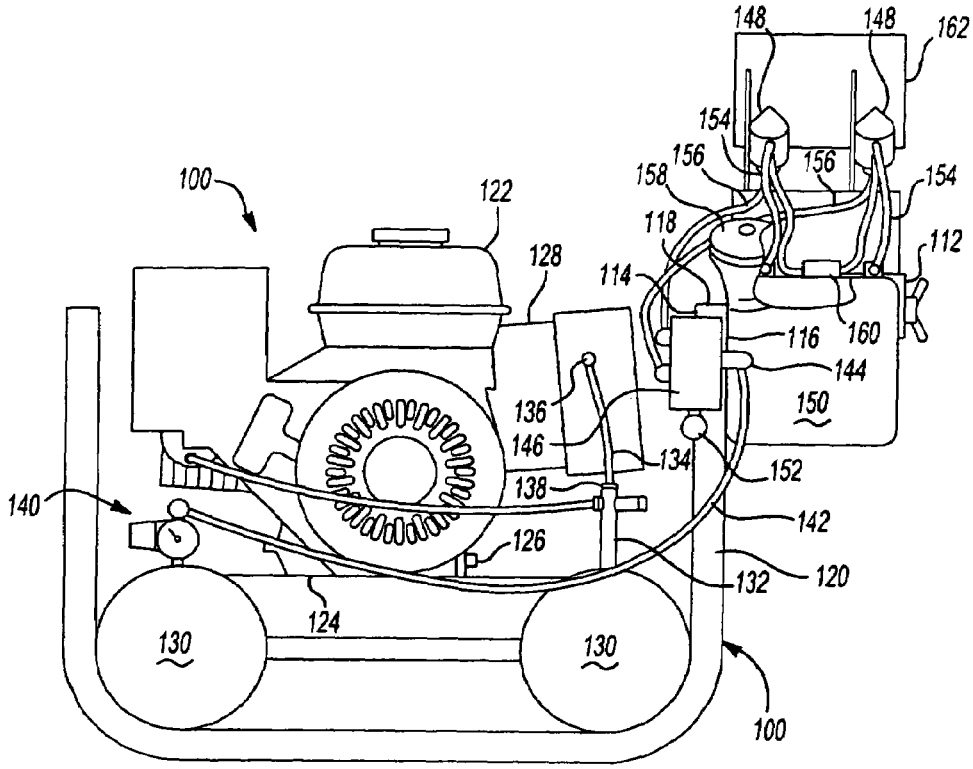
FIG. 10 illustrates a perspective view of a second preferred embodiment of the present invention.

A second preferred embodiment is shown in FIG. 10 and comprises a spraying device 100 formed of two major components: a compressor air tank and frame assembly 110 forms the first component and a reservoir/nozzle assembly 112 forms the second component. The independent components 110,112 are preferably proportioned to allow for separate shipping by common carrier. The reservoir/nozzle assembly 112 is removably attachable to the frame assembly 110 by means of a drop-on cradle 114 preferably in the form of an inverted U-shape. The reservoir/nozzle assembly 112 is attached to the cradle 114 at one end 116 and the "U" portion 118 of the cradle 114 straddles the frame 120 of the frame assembly 110 to form a two-component high performance energy efficient spraying device 100.

The frame assembly 110 includes a gasoline engine 122 mounted on a mounting plate 124 above at least one and more preferably two air tanks 130 forming an overall low profile and stable device 100. In a preferred embodiment, the engine 122 is a high efficiency Honda gas engine coupled to a high capacity direct drive compressor 128, thereby eliminating all belt/pulley, chain or gear drives making this a high efficiency energy source. At least one and preferably two twin air reservoir tanks 130 are located below the engine 122 and compressor 128 and provide storage for the high-pressure air as well as providing air pulsation dampening for the nozzle air feed lines 156. A switch 132, preferably an automatic switch, is located on top of one of the air reservoir tanks 130 (the right hand tank in FIG. 10) engages and disengages the high-pressure compressor 128. The high-pressure air is supplied from the compressor 128 to the reservoir tanks 130 by an armored feed line 134 that extends from an output port 136 on the compressor 128 to a feed port 138 on the automatic switch 132. A air regulator/gauge quick coupler assembly 140 is located on the top of the opposing reservoir tank 130, thereby allowing dual usage of the device 100 as a high output standard air compressor as well as a spraying device.

As described above, the reservoir/nozzle assembly 112 simply drops into position on one side of the compressor frame 120. A flexible air feed line 142 with swivel coupler 144 attaches to a manual valve 146 preferably located on the frame 120 at a point near or at the drop on cradle 114. At least one and preferably two Venturi nozzles 148 are mounted above a liquid formulation or reservoir tank 150 and air is directed to the Venturi nozzles 148 by moving the manual switch 152 mounted on the manual valve 146 to the ON position. Like the first preferred embodiment, the manual switch 152 is preferably a 4 way/3 position switch having an ON, OFF and CLEAN position. Additionally, the Venturi nozzles 148 are preferably similar to those shown in FIGS. 2–8 and operate as described above. The air flow passing through the nozzles 148 creates a low pressure vacuum in the fluid supply circuit and supply tubes 154 allowing the liquid formulation to be drawn up the supply circuit or, more accurately, pushed up the liquid formulation supply circuit by the higher pressure atmospheric air applied to the formulation in the liquid reservoir tank 150. The liquid supply tubes 154 going to the tank 150 may or may not be restricted, depending on the product being used, to regulate the flow of the liquid formulation to the nozzles 148. Strainer screens (not shown) may be positioned within the liquid supply lines 154 to eliminate or reduce nozzle plugging.

By regulating the pressure of the air to the nozzles 148, varying degrees of droplet size generation may successfully be achieved. The high-pressure air bombards the liquid stream just as it exits the nozzle 148, shattering the liquid stream into uniform droplets. The size of these droplets is determined by the pressure and volume of air directed at the liquid stream. A separate air feed line 156 is attached to the back of each nozzle 148 and feeds air into the exhaust port 46 (See FIGS. 5 and 7) when the manual switch 152 is in the CLEAN position. The nozzle is cleaned as described above, allowing the operator to clean the nozzle without shutting down or disassembling the device 100 in any way.

Advantageously, the nozzles 148 are preferably made of corrosion resistant material such as stainless steel allowing the operator to use any formulation of liquid for spraying. Additionally, the reservoir tank 150 is preferably formed of ultraviolet resistant material such as plastic and preferably incorporates a wide mouth filler cap with gauge 158. Incorporated into the twin nozzle assembly 148 is a valve, preferably a simple ball valve 160 located between the two nozzles 148 in the air supply line 156 that allows the operator to spray with one or two nozzles 148 depending on how much material output is desired. Mounted above the nozzles is a shield 162 as described above. In addition to the advantages of the shield set forth above, the shield 162 protects the nozzles 148 in case the assembly tips over as well as doubling for a carrying handle for the reservoir/nozzle assembly 112. Overall, the device 100 allows for a preferable liquid formulation rate of up to 6 ounces of oil based liquid for atomization and higher flow rates of other products. The unit is compact, highly efficient and easily transportable.

Additional advantages of this device are that is may also be converted to a gas-powered portable compressor in seconds. The device is a self-contained unit requiring no outside power source and can is easily transported by hand or used in conjunction with a 4 wheeler, a utility vehicle, a snow mobile, a pick up truck or boat, for example, and may be provided with security straps for securing to a vehicle during transport to a remote location.

Figure 11:
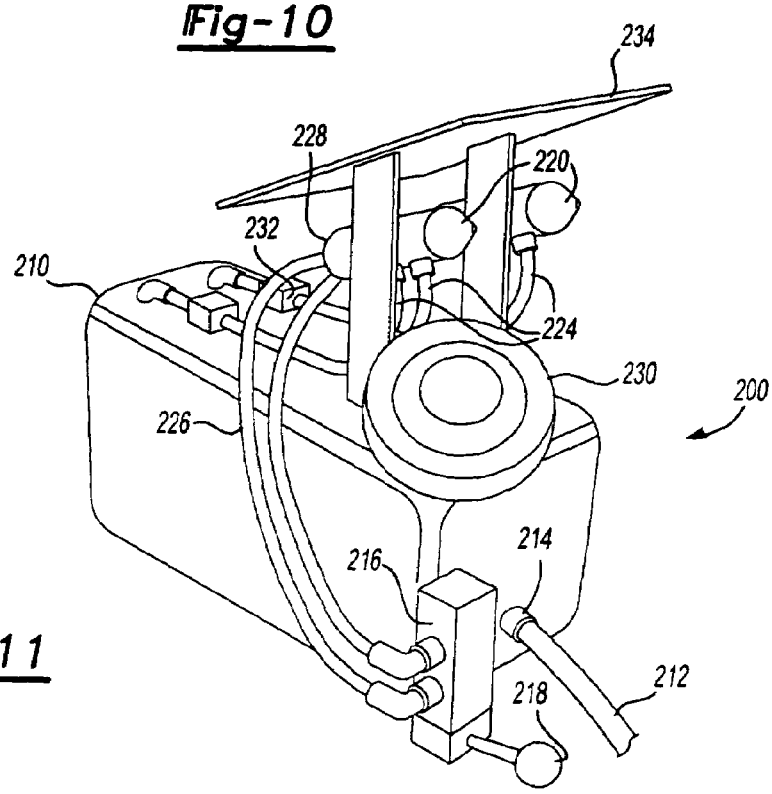
FIG. 11 illustrates a perspective view of a third preferred embodiment of the present invention.

A third preferred embodiment of the spraying device 200 is shown in FIG. 11 and includes a reservoir/nozzle assembly 210 for use with a pre-existing portable air compressor. The device 200 comes equipped with several attachment devices for supporting the reservoir/nozzle assembly 210 within the vicinity of a pre-existing portable air compressor and other attachment devices for mounting the spraying device 200 to vehicles, such as truck stake pockets, floor mounts, or along side a compressor, as well as to a standard pontoon compressor carrying frame as shown in FIG. 12.

The spraying device 200 receives all the air energy used for the liquid atomization process described above and illustrated in FIGS. 1–10, by way of a flexible air feed line 212 with swivel coupler 214. This flexible line 212 is coupled to any air source of appropriate capacity, such as the compressor air tank 12, 110 described above. The flexible line 212 extends from the air source to a manual valve 216 having a 4 way/3 position switch 218 including an ON, OFF and CLEAN position as described above. When the switch 218 is in the ON or CLEAN position, air is directed at least one and preferably two Venturi nozzles 220 mounted above the liquid formulation/reservoir tank 222. The spraying device 200 with Venturi nozzles 220 works similar to the first and second preferred embodiments described above and illustrated in FIGS. 1–10. Like the second preferred embodiment, the liquid supply tubes 224 going to the tank 222 may or may not be restricted, depending on the product being used, to regulate the flow of the liquid formulation in the nozzles 220. The supply tubes 224 may also include strainer screens to eliminate or reduce nozzle plugging.

Similarly, a separate air feed line 226 is attached to the back 228 of the nozzles 220 and directs air into the exhaust port 46 (FIGS. 5 and 7) when the switch 218 is in the CLEAN position. Advantageously, the nozzles 220 are preferably made of corrosion resistant material such as stainless steel allowing the operator to use any formulation of liquid for spraying. Additionally, the reservoir tank 222 is preferably formed of ultraviolet resistant material such as plastic and preferably incorporates a wide mouth filler cap with gauge 230. Incorporated into the twin nozzle assembly 220 is a valve, preferably a simple ball valve 232 located between the two nozzles 220 in the air supply line 226 that allows the operator to spray with one or two nozzles 220 depending on how much material output is desired. Mounted above the nozzles is a shield 234 as described above. In addition to the advantages of the shield set forth above, the shield 234 protects the nozzles 220 in case the assembly tips over as well as doubling for a carrying handle for the reservoir/nozzle assembly 210.

Figure 12A:
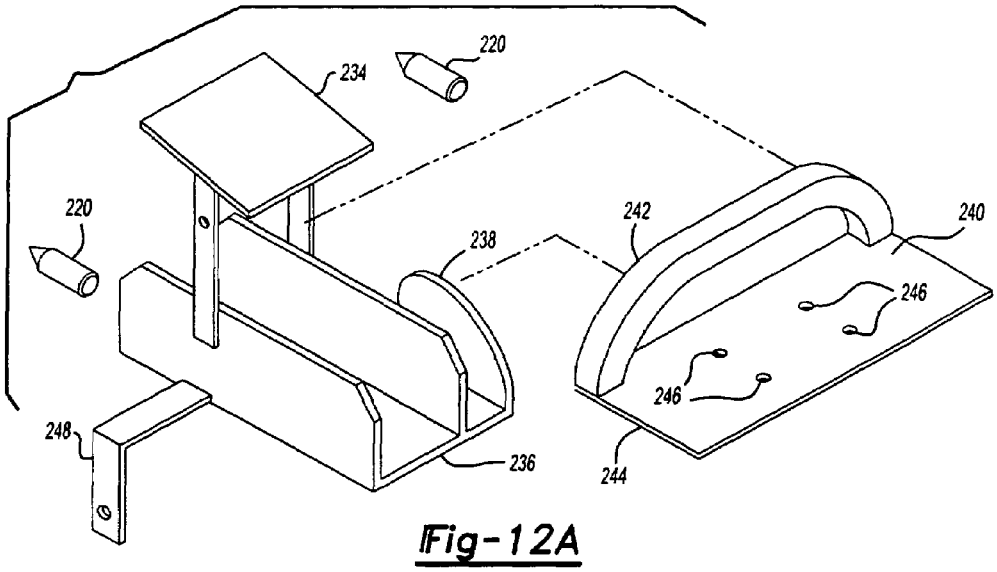
FIGS. 12A–12D illustrate attachment devices used in conjunction with the present invention of FIG. 11.

With reference to FIGS. 12A–D, several attachments are there shown for attaching the spraying device 200 to a compressor and additional devices such as a truck or other vehicles, an extending stand (FIGS. 9A and (9B) or any other carrying means. FIG. 12A illustrates a U-shaped cradle 236 as described in the second preferred embodiment above and includes an L-shaped bracket 238 for mounting attachment to a truck bed for example. Additionally, a separate bracket 240 may be provided with a U-shaped handle 242 for sliding the L-shaped bracket 238 within for supporting the U-shaped cradle 236 and providing an attachment plate 244 with openings 246 for securing the device 200 to a flat area, such as the bed of a truck. A second bracket 248 secures the reservoir/nozzle assembly 210 within the U-shaped cradle 236.

Figure 12C:
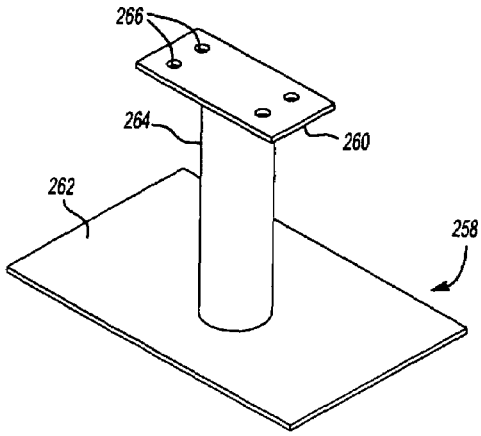
Figure 12B:
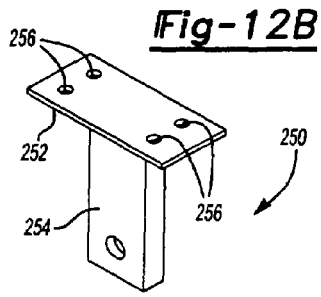

FIG. 12B illustrates an attachment 250 for use with a stake box opening in the bed of a pick up truck, for instance. The attachment 250 includes a plate 252 extending horizontally atop a leg 254. The leg 254 is generally sized to fit easily within a stake box opening. The plate 252 includes openings 256 that align with openings 246 for securing the attachment 250 to the bracket 240 and supporting the device 200 within a stake box opening.

FIG. 12C illustrates another attachment 258 for use with the U-shaped cradle 236 when the operator desires a free standing spraying device 200. The attachment 258 is configured with an upper plate 260 and a lower plate 262 and includes a leg 264 that extends between the plates. The upper plate 260 is preferably smaller in size than the lower plate 262 and includes openings 266 that align with openings 246 for securing the attachment 258 to the bracket 240. Lower plate 262 is preferably large and serves to aid in supporting the spraying device 200 in an upright position on any flat surface area.

Figure 12D:
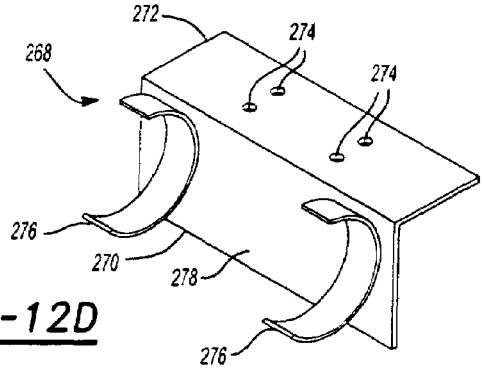

FIG. 12D illustrates another attachment 268 for use with the U-shaped cradle 236 and includes an L-shaped bracket 270 having an upper horizontal leg 272 equipped with openings 274 that align with openings 246 on bracket 240. At least one and preferably a pair of opposing C-shaped arms 276 are fixed to the lower vertical leg 278 of the L-shaped bracket 270 and may be used to clamp the spraying device 200 to a variety of pieces such as a bracket or frame of the pre-existing portable air compressor.

Figure 13:
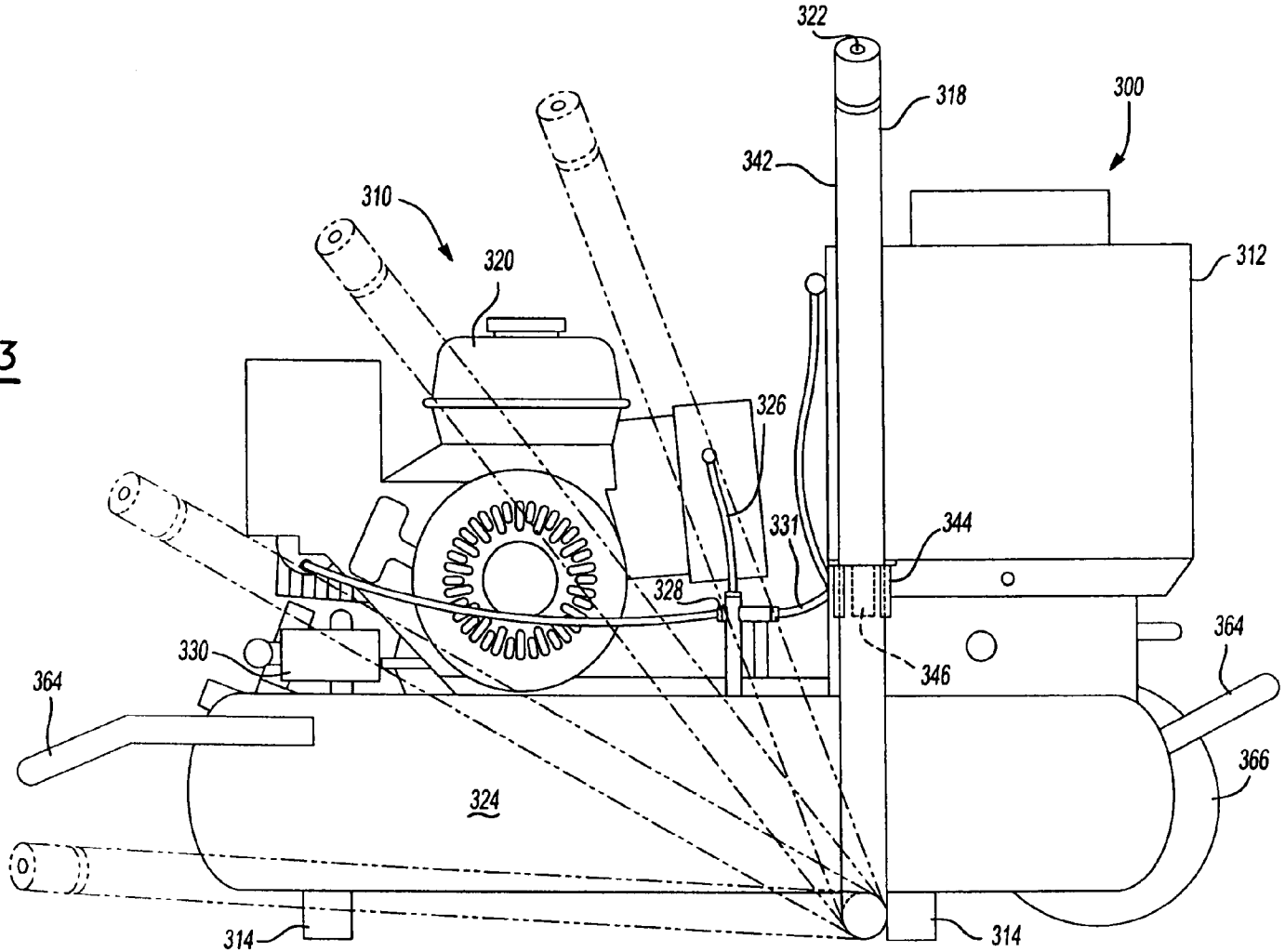
FIG. 13 illustrates a perspective view of a fourth preferred embodiment of the present invention.
Figure 14:
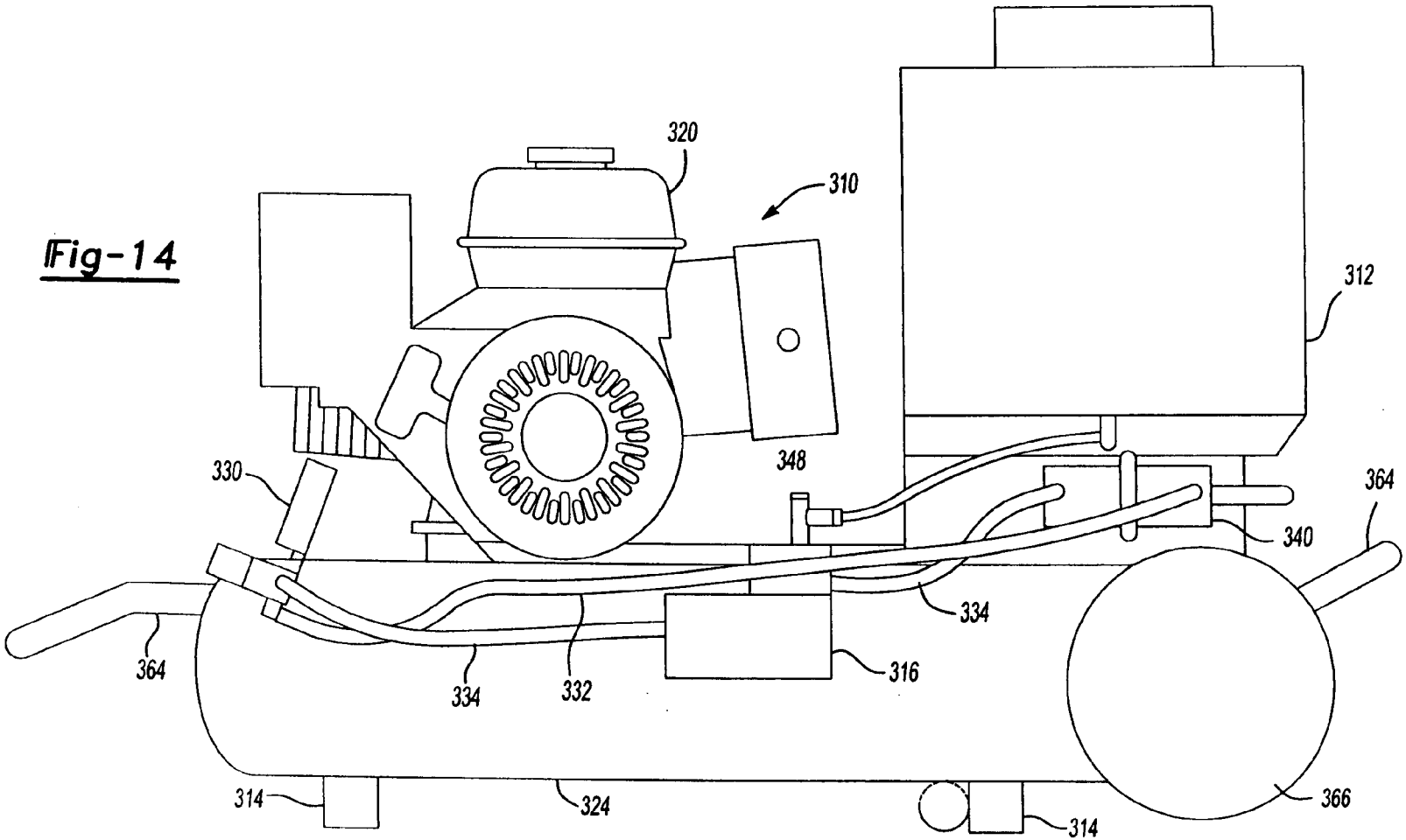
FIG. 14 illustrates a cross-sectional view of the fourth preferred embodiment of the present invention.
Figure 15:
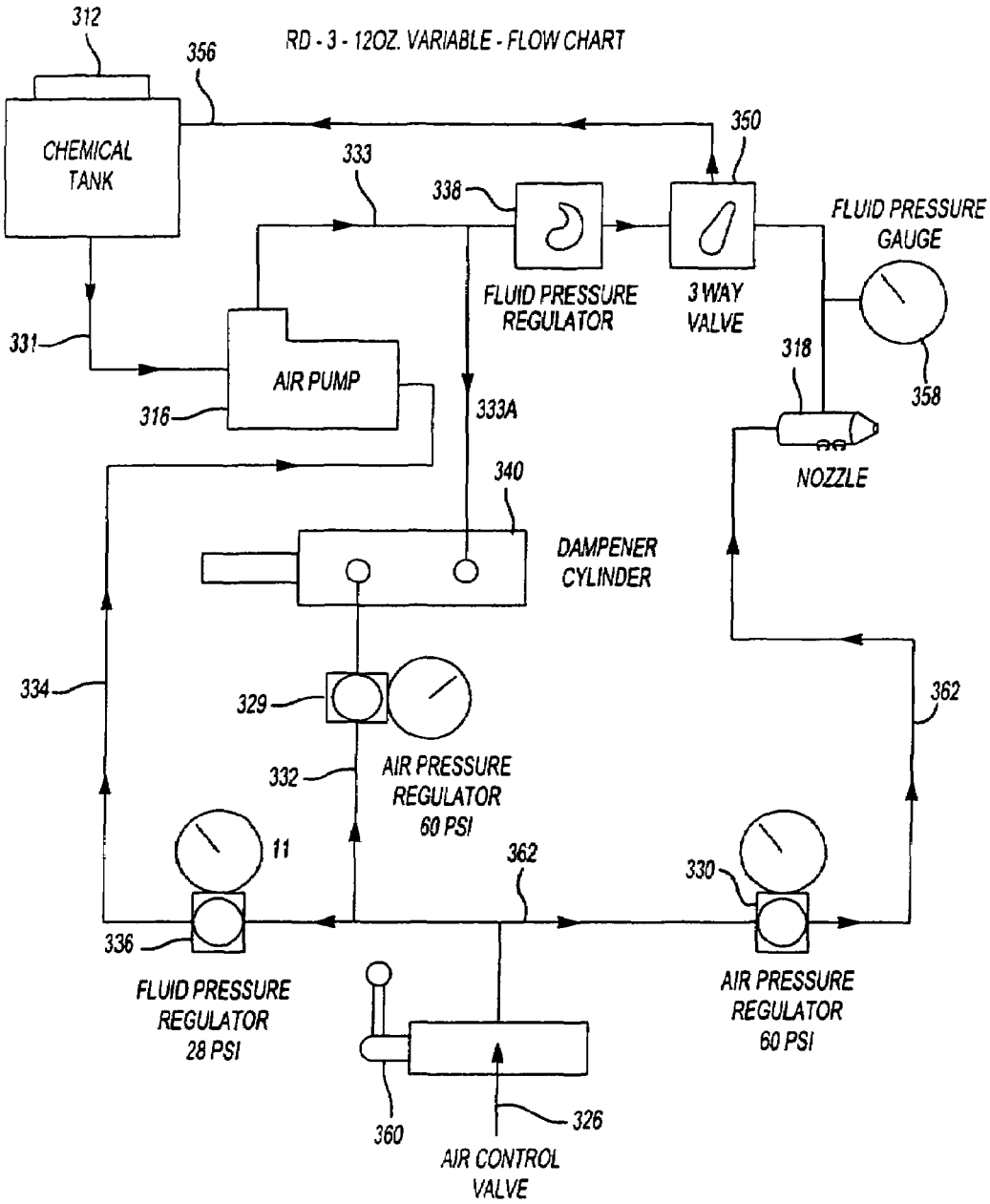
FIG. 15 illustrates a flow chart of the method for use of the fourth preferred embodiment of the present invention.

With reference to FIGS. 13–15, a fourth preferred embodiment of the present invention is there shown and illustrates a variable flow Ultra Low Volume liquid formulation spraying machine able to atomize droplets from a liquid formulation on a consistent basis attesting to its efficient design. The spraying machine 300 is composed of five major components: an engine and compressor assembly 310, a fluid formulation tank 312 with attachments, an air tank frame assembly 314, an air driven liquid formulation pump 316, and a nozzle assembly 318. The engine 320 is preferably a direct drive engine and more preferably a Honda direct drive engine.

Although the nozzle assembly 318 is preferably a Venturi nozzle assembly and works similar to the first and second preferred embodiments described above and illustrated in FIGS. 1–10, it should be seen that the present invention may also utilize a gravity, siphon, or pressure fed nozzle having either an internal or external mix design. The nozzle assembly 318 provides an internal mix nozzle to create uniform droplet output by combining a pressurized liquid formulation with a high-pressure air prior to the mixture being forced out of the nozzle tip 322. The resulting extremely high turbulence from the forces applied inside the nozzle assembly 318 causes the break-up of the pressurized liquid formulation. This internal nozzle mixing mechanism provides a highly efficient transfer of energies as evidenced by the resulting high fluid output rates in relation to the horsepower input energy available to the device 300. By combining both liquid and air forces in the manner described below, the device 300 is able to successfully achieve variable flow rates, high liquid formulation output and consistent droplet formation.

More specifically, the present invention utilizes a direct drive engine and compressor assembly 310, wherein the engine may be manufactured by Honda, which supplies high-pressure air to one and preferably two twin air storage tanks 324, which also comprise part of the frame assembly 314. This high-pressure air travels to the tanks 324 through a supply tube 326 that is in engagement, such as fluid engagement, with the engine's 320 automatic engagement/disengagement switch 328. In a preferred embodiment, the supply tube 326 is an armored supply tube. Output air is directed to at least one and preferably three separate adjustable air pressure regulators 329, 330, 336 creating three separate air supplies. In the embodiment comprising three separate air supplies, it should be seen that one air supply flows to the air driven liquid formulation pump 316 through line 334, one air supply going or flowing to the nozzle assembly 318 via line 362, and one air supply going or flowing to the damping cylinder 340 via line 332. Pressure to the liquid formulation pump 316 is regulated to optimize pump performance as well as changing output fluid pressure depending on the liquid flow rate desired to the nozzle 318. In a preferred embodiment, the pump 316 multiplies the liquid output pressure relative to air input pressure by a factor of up to four or more. The selected or chosen formulation fluid may be gravity fed to the liquid side of the air/fluid pump via line 331.

The fluid, when exiting pump 316 comprised of increased fluid pressure, is directed or displaced via line 333, 333A to the damping cylinder 340 and fluid pressure regulator while en route or moving toward the nozzle 318. The fluid output pressure may ultimately be regulated by fluid pressure regulator 338 located along line 333. It should be seen that incorporated within the air/fluid circuits is a pulsation or damping cylinder 340. The damping cylinder 340 dampens the liquid fluid pulsations to the nozzle 318 caused by the cycling of the air driven liquid formulation pump 316. The cylinder 340 is in fluid connection with the nozzle assembly 318 via lines 332 and 333A.

The nozzle assembly 318 is fixedly attached to a mast 342 that is pivotal from a vertical position to a fully horizontal position (shown in phantom in FIG. 13.) The nozzle assembly 318 is also rotatable to allow for directional flow of the atomized liquid stream exiting through the nozzle 318 or a nozzle tip 332. In addition to providing multi-directional spraying, the mast 342 may be locked in a vertical position by any type of locking mechanism known in the art. In the preferred embodiment, the mast latch 344 is a slip ring attached to the mast for locking purposes to the frame 314.

The liquid formulation tank 312 utilizes a bottom feed supply line 331 to the pump 316 with preferably a filter screen in line or in tank to eliminate debris from entering the fluid supply line 331. A bypass valve 350 in fluid connection with the fluid pressure regulator 338 via fluid supply line 362 to the nozzle assembly 318 allows for nozzle bypass back to the fluid formulation tank 312 through a bypass line 356 when the pump 316 may need to be purged of air, typically if the liquid formulation tank 312 is inadvertently run dry. This feature is also used for chemical agitation prior to being sprayed. A fluid pressure gauge 358 is provided in line 333 to allow for a visual check of the desired pressure during operation.

A manual switch 360 is preferably a 3 way/2 position switch having an ON and OFF position. When the switch 360 is in the ON position, air is directed through fluid lines 332, 334, and 362 respectively as described above. In those embodiments of the present invention which comprise a switch 360 having a CLEAN position, it should be seen that when the switch 360 is in the CLEAN position, air is directed through fluid line 362 and one of the two fluid pressure regulators 330 to the nozzle assembly 318. The nozzle assembly 318 and nozzle tip 322 is cleaned in the manner described above and illustrated in FIGS. 5 and 7. Carrying handles 364 are preferably mounted on either end of the air tank frame assembly 314 for lifting, as well as at least one wheel 366 or tire mounted under the frame 314 so that the entire device 300 may be easily rolled to any location for successful operation.

It is also envisioned that the twin air storage tanks 324 may be disengaged from the fluid formulation tank 312 and advantageously used to power air tools, such as a nail gun or other where the fluid and air pressure regulators 330,336, 338 together with the pulsation dampening cylinder 340 provide a reservoir of high pressure air to the tool while reducing pulsation of air flow, eliminating spurts of air to the tool. Additionally, the nozzle assembly 318 may alternatively be a pressure fed nozzle implementing the fluid and air pressure regulators 330,336,338 with the pulsation damping cylinder 340 provided with the device 300. This pressure fed nozzle may include an internal mix pressure feed, similar to the Venturi nozzle described above, or an externally mixed pressure feed that is well known in the art. The pressure feed nozzle may also be visually monitored by the fluid pressure gauge 358 provided with the device 330 and described above.

The preferred embodiments of the present invention have been disclosed. A person of ordinary skill in the art would realize however, that certain modifications would come within the teachings of this invention. Therefore, the following claims should be studied to determine the true scope and content of the invention.

The invention claimed is:

1. A portable spraying system comprising:

a first component comprising a compressor air tank and frame assembly including a gasoline engine direct drive compressor for introducing a regulated air flow into the system, at least one air storage tank in fluid connection with said compressor for reducing air pulsation within said regulated air flow and an automatic engagement switch intermediate said storage tank and said compressor for engaging and disengaging said compressor; and a second component comprising a reservoir and nozzle assembly including a Venturi nozzle fluidly connected to said compressor via a manual switch, said manual switch applying said regulated air flow from said compressor to said Venturi nozzle, said Venturi nozzle including a nozzle cone external to and internally fluidly connected with said Venturi nozzle and a reservoir tank fluidly connected to said Venturi nozzle by a liquid supply tube, said reservoir tank containing a solution to be sprayed, said liquid supply tube having a restriction to regulate said solution flow to said nozzle, wherein said second component is reliably attached to said frame of said first component by attaching means, said attaching means comprising a U-shaped cradle, wherein said first and second components are self-contained and may be used separately or together.

2. The portable spraying system of claim 1, said second component further comprising a second Venturi nozzle fluidly connected to said compressor and a valve intermediate said Venturi nozzles for allowing fluid flow to one or both nozzles.

3. The portable spraying system of claim 1, said first component further comprising a regulator/gauge quick coupler assembly removably attached to said at least one air storage tank providing dual usage of said first component as a spraying device or an air compressor.

4. The portable spraying system of claim 2, wherein said Venturi nozzles are formed of a corrosion resistant material.

5. The portable spraying system of claim 2, wherein said second component further comprises a shield extending from said cradle above said Venturi nozzles for protecting said nozzles when said spraying device is accidentally tipped.

6. The portable spraying system of claim 1, wherein said restriction of said liquid supply tube is a fixed restriction.

7. The portable spraying system of claim 1, wherein said restriction of said liquid supply tube is a variable restriction.

8. The portable spraying system of claim 1, wherein said manual switch is a 4-way, 3-position manual control pneumatic valve providing a means for directing said regulated air to said nozzle cone for cleaning of said nozzle without disassembly of said nozzle or shut down of said spraying system.

9. A portable spraying system comprising:

a first component comprising a compressor air tank and frame assembly including a direct drive compressor for introducing a regulated air flow into the system, at least one air storage tank in fluid connection with said compressor for reducing air pulsation within said regulated air flow and a first switch intermediate said storage tank and said compressor for engaging and disengaging said compressor; and a second component comprising a reservoir and nozzle assembly including a nozzle fluidly connected to said compressor via a second switch, said second switch applying said regulated air flow from said compressor to said nozzle, and a reservoir tank fluidly connected to said nozzle by a liquid supply tube, said reservoir tank containing a solution to be sprayed, wherein said nozzle includes a nozzle cone external to and internally fluidly connected with said nozzle, wherein said second component is releasably attached to said frame of said first component by attaching means, said attaching means comprising a cradle or bracket.

10. The portable spraying system of claim 9, wherein the first switch comprises an automatic engagement switch and the second switch comprises a manual switch.

11. The portable spraying system of claim 9, wherein said liquid supply tube includes a restriction to regulate said solution flow to said nozzle.

12. The portable spraying system of claim 9, wherein said second component further comprising a second nozzle fluidly connected to said compressor and a valve intermediate said nozzles for allowing fluid flow to one or both nozzles.

13. The portable spraying system of claim 9, wherein said first component further comprising a regulator/gauge quick coupler assembly removably attached to said at least one air storage tank providing dual usage of said first component as a spraying device or an air compressor.

14. The portable spraying system of claim 12, wherein said nozzles are formed of a corrosion resistant material.

15. The portable spraying system of claim 12, further including an attachment means comprising U-shaped cradle for reliably attaching said frame and said first component.

16. The portable spraying system of claim 12, wherein said second component further comprises a shield extending from said cradle above said nozzles for protecting said nozzles when said spraying device is accidentally tipped.

17. The portable spraying system of claim 11, wherein said restriction of said liquid supply tube is a fixed restriction.

18. The portable spraying system of claim 11, wherein said restriction of said liquid supply tube is a variable restriction.

19. The portable spraying system of claim 10 wherein said manual switch is a 4-way, 3-position manual control pneumatic valve providing a means for directing said regulated air to said nozzle cone for cleaning of said nozzle without disassembly of said nozzle or shut down of said spraying system.

20. A portable spraying system comprising:

a first component comprising a compressor air tank and frame assembly including a direct drive compressor for introducing a regulated air flow into the system, at least one air storage tank in fluid connection with said compressor for reducing air pulsation within said regulated air flow and a first switch intermediate said storage tank and said compressor for engaging and disengaging said compressor; and a second component comprising a reservoir and Venturi nozzle assembly including a Venturi nozzle fluidly connected to said compressor via a second switch, said second switch applying said regulated air flow from said compressor to said Venturi nozzle, and a reservoir tank fluidly connected to said Venturi nozzle by a liquid supply tube, said reservoir tank containing a solution to be sprayed, wherein said second component is releasably attached to said frame of said first component, by attaching means, said attaching means comprising a cradle or bracket, and wherein said first and second components are self-contained and may be used separately or together.

* * * * *

UNITED STATES PATENT AND TRADEMARK OFFICE

CERTIFICATE OF CORRECTION

PATENT NO. : 7,073,734 B2
APPLICATION NO. : 10/867135
DATED : July 11, 2006
INVENTOR(S) : Bruce Dorendorf et al.

It is certified that error appears in the above-identified patent and that said Letters Patent is hereby corrected as shown below:

Col. 12, line 1
replace "reliably"
with --releasably--.

Col. 13, line 10
replace "reliably"
with --releasably--.

Signed and Sealed this

Tenth Day of October, 2006

JON W. DUDAS
*Director of the United States Patent and Trademark Office*